US005421663A

United States Patent [19]

Bravo

[11] Patent Number: 5,421,663

[45] Date of Patent: Jun. 6, 1995

[54] BUTTER DISPENSER

[76] Inventor: Sergio M. Bravo, 2872 Tigertail Dr., Los Alamitos, Calif. 90720

[21] Appl. No.: 105,590

[22] Filed: Aug. 11, 1993

[51] Int. Cl.[6] ..... A47G 19/18

[52] U.S. Cl. ..... 401/82; 401/12; 401/84; 401/176; 222/391

[58] Field of Search ..... 401/12, 82, 83, 84, 401/176; 222/391

[56] References Cited

U.S. PATENT DOCUMENTS

| | | | |
|---|---|---|---|
| D. 217,007 | 3/1970 | Smith | D44/29 |
| D. 245,140 | 7/1977 | Benson | D7/99 |
| D. 315,083 | 3/1991 | Anderson et al. | D7/670 |
| 1,164,961 | 12/1915 | Rich | 401/84 |
| 2,458,120 | 1/1949 | Volpini . | |
| 2,581,745 | 1/1952 | Amorino et al. . | |
| 2,589,000 | 3/1952 | Vani | 206/56 |
| 2,619,937 | 12/1952 | Kostka | 401/83 |
| 2,845,707 | 8/1958 | Redmond | 31/21 |
| 2,972,407 | 2/1961 | Taylor | 206/56 |
| 2,980,247 | 4/1961 | DiGiantomasso | 206/56 |
| 3,162,884 | 12/1964 | Bordwine et al. | 14/514 |
| 3,374,048 | 3/1968 | Koskinen | 401/98 |
| 3,669,063 | 6/1972 | Daniluke | 118/13 |
| 3,756,727 | 9/1973 | Gallagher | 401/84 |
| 3,920,156 | 11/1975 | Hicks | 222/80 |
| 4,352,579 | 10/1982 | Yi | 401/84 X |
| 4,544,083 | 10/1985 | Schroeder | 222/47 |
| 4,964,745 | 10/1990 | Deitz | 401/131 |

FOREIGN PATENT DOCUMENTS

| | | | |
|---|---|---|---|
| 484180 | 9/1917 | France | 401/84 |
| 812352 | 7/1949 | Germany | 401/82 |
| 426771 | 4/1935 | United Kingdom | 401/84 |

*Primary Examiner*—Steven A. Bratlie
*Attorney, Agent, or Firm*—Christie, Parker & Hale

[57] ABSTRACT

A butter dispenser having a housing and a piston slidable within the housing. The housing has four flat walls each with an inwardly and downwardly extending tongue formed at a lower end to hold the butter in the applicator. The piston has a lower face engageable with an upper end of the stick of butter to move the butter through the housing.

15 Claims, 2 Drawing Sheets

BUTTER DISPENSER

BACKGROUND OF THE INVENTION

This invention relates to food containers and applicators and, more particularly, to a container/applicator for dispensing a stick-shaped spreadable food item such as butter or margarine.

Traditionally, to apply butter to a piece of food a knife is used to cut the butter from the stick and spread it on the food. For food such as corn-on-the-cob, the butter has a tendency to slip off of the corn and knife while being spread. For other food, such as toasted bread, the pressure exerted by the knife may crush the bread or contact between the knife and bread may tear the bread.

To address these and other problems, a number of butter dispensing devices have been proposed. Bordwine, et al. U.S. Pat. No. 3,162,884 discloses a telescoping butter dispenser having inner and outer telescoping housing members and a multi-component plunger system for forcing the butter out of the dispenser. Inwardly projecting bosses are formed adjacent the dispenser outlet to prevent the butter from exiting the dispenser until sufficient force has been applied to extrude the butter past the bosses. To fully dispense the stick of butter, the user must change the plunger configuration when the butter has been partially dispensed.

Deitz U.S. Pat. No. 4,964,745 discloses a butter dispenser wherein a wire extends across the dispenser outlet. The wire serves to retain the butter in the dispenser until sufficient force is applied to force the butter around the wire so that the wire cuts the stick of butter in two.

There is accordingly a need for a butter dispenser which is simple to make and use, which adequately retains the butter within the dispenser and which does not significantly deform a stick of butter which is dispensed.

SUMMARY OF THE INVENTION

In one embodiment of the invention, a container/applicator (dispenser) for butter or other stick-shaped spreadable food has a housing and a piston slidable within the housing. The housing has four flat walls with an inwardly and downwardly extending tongue formed at a lower end of at least one wall. The piston has a lower face engageable with an upper end of the stick of butter to move the butter through the housing. The two-piece dispenser is thus simple to make and use, easy to wash and inexpensive.

BRIEF DESCRIPTION OF THE DRAWINGS

The above-mentioned and other aspects of this invention are more clearly set forth in the following detailed description of the presently preferred and other embodiments of this invention, presented with reference to the accompanying drawings wherein.

DESCRIPTION OF THE ILLUSTRATED EMBODIMENT

Figure 1:
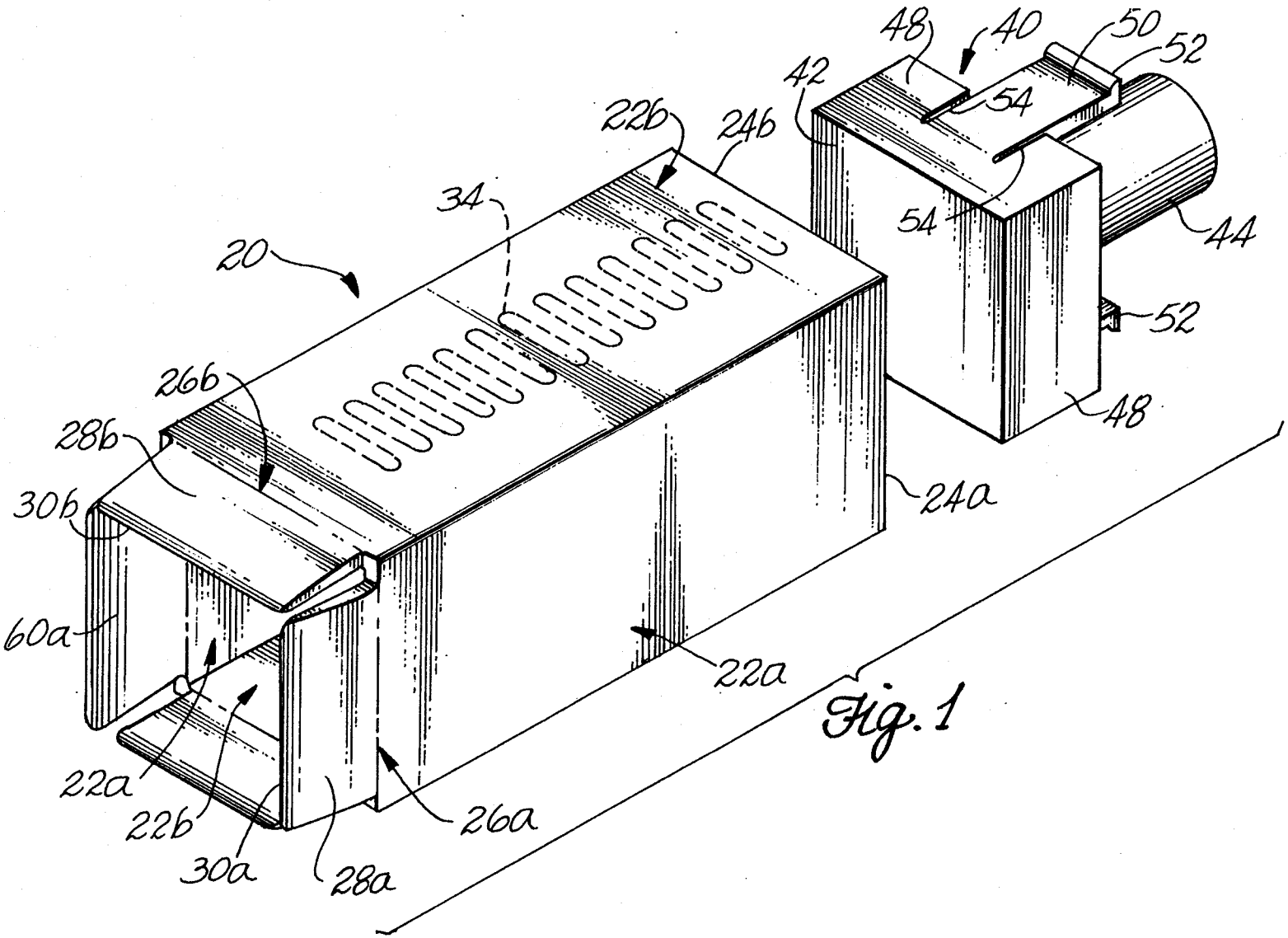
FIG. 1 is a perspective view of a dispenser constructed according to principles of the present invention.

As shown in FIG. 1, a dispenser has a housing 20 unitarily formed of polypropylene and having first and second opposed pairs of flat rectangular walls **22*a* and 22*b*. The housing is thus substantially formed as a right parallelpiped having an inlet defined by the upper edges 24*a* and 24*b* of the first and second pairs of walls, respectively. At the lower edges 26*a* and 26*b* of the first and second pairs of walls, respectively, first and second pairs of tongues 28*a* and 28*b* are unitarily formed with the walls and extend downwardly and inwardly from the walls. Lower edges 30*a* and 30*b* of the first and second pairs of tongues, respectively, define an outlet from the housing. The housing has a central axis 100** which accordingly has a downward direction defined from the inlet to the outlet.

Figure 2:
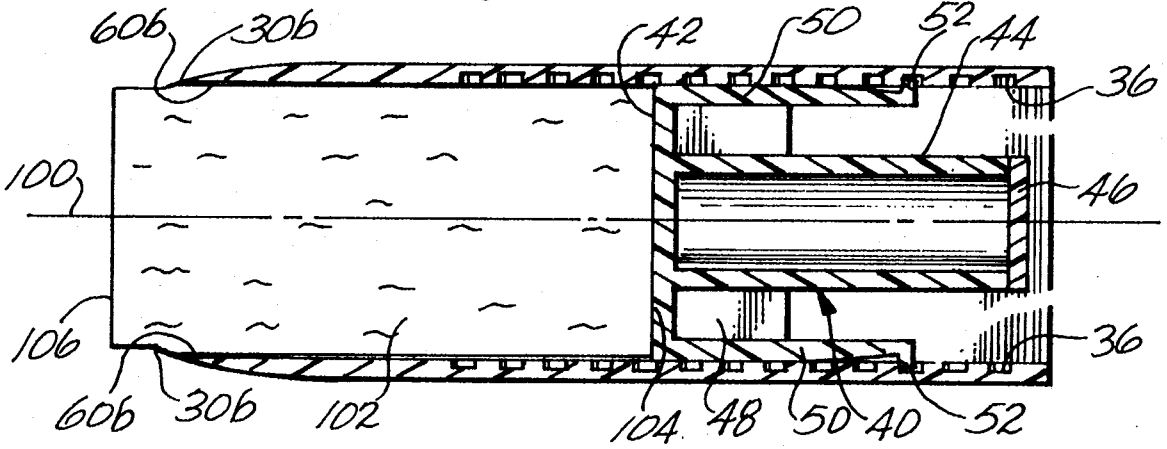
FIG. 2 is a side cross-sectional view of the dispenser of FIG. 1 containing a substantially whole stick of food spread.

Each wall of the second pair of walls **22*b* has a row of detents 34. The detents are formed as straight-bore, laterally extending, slots 36 formed in the inner surfaces of the second pair of walls (FIG. 2). The outer surfaces of the first and second pairs of walls 22*a*, 22*b* and the inner surfaces of the first pair of walls 22*a* are smooth (FIG. 1). A piston 40 also formed of polypropylene is axially slidable within the housing. As is best seen in FIG. 1, the piston has a square lower face 42 and an upwardly extending annular handle shaft 44 which bears a cap 46 (FIG. 2). A four-sided skirt 48 is unitarily formed with and extends upwardly from the lower piston face 42. A pair of arms 50 extend upwardly from two opposite sides of the skirt. The upper ends of the arms bear outwardly facing claws 52. For increased flexibility, upwardly extending slots 54** are formed in the skirt alongside the lower portions of the arms.

With the container empty, as shown in FIG. 1, the inner surfaces **60*a* and 60*b* of the first and second pairs of tongues, respectively, are concave facing inward so as to form smooth unitary surfaces with the inner surfaces of the two pairs of walls. As further shown in FIG. 2**, the tongues are tapered to a minimum thickness along their lower edges.

To load the dispenser, a stick of food spread 102 is inserted through the housing inlet. The piston is then inserted through the inlet so that the lower face 42 of the piston engages the upper face 104 of the stick. As the width of the stick is greater than the width of the outlet of the empty dispenser, the tongues will retain the stick against moving out of the outlet unless the stick is forced through the outlet via exertion of pressure on the piston handle. As the lower face 106 of the stick passes through the outlet, the tongues will exert an inward force upon the stick causing the stick to very slightly extrude, thus reducing the cross-sectional area of the stick as it passes through the outlet. Similarly, the corresponding outward pressure exerted by the stick on the tongues will normally flex the tongues slightly in an outward direction, although the tongues preferably still extend slightly inwardly to resiliently hold the stick inside the dispenser.

Figure 3:
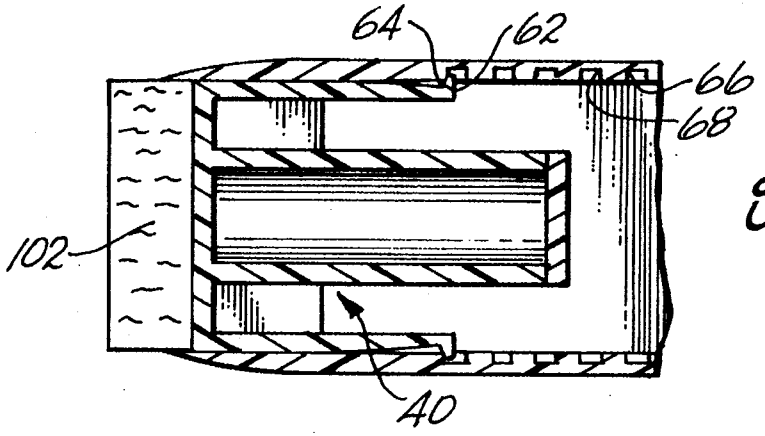
FIG. 3 is a partial side cross-sectional view of the dispenser of FIG. 1 containing a substantially expended stick of food spread.

As the stick becomes substantially expended, as shown in FIG. 3, the piston will pass adjacent the tongues. As the width of the piston is substantially the same as the internal width of the housing between the first and second pairs of walls, the piston further flexes the tongues in an outward direction until the lower face of the piston reaches the outlet. At this point the inner surfaces of the tongues are substantially co-planar with the inner surfaces of the respective walls.

As shown in FIGS. 2 and 3, a detent mechanism for incrementally moving the food through the dispenser housing is shown. Each claw 52 of the pair of arms 50 has an upper face 62 substantially perpendicular to the adjacent wall, and a lower face 64 oblique to the wall. Accordingly, with sufficient downward force exerted on the piston handle, the piston may freely slide downward within the housing as the interaction of the lower surface of each claw with the lower surface 68 of each slot 36 flexes the claw's arm inward to disengage from the slot. Conversely, any force exerted on the piston in an upward direction, such as force transmitted from the application of the spread to a piece of food, will cause the upper face 62 of the claw to bear squarely against the upper face 68 of a slot 36 thereby preventing upward movement of the piston. Each slot is thus a detent and the slots, arms and claws form the detent mechanism. Each slot may be formed as a recess in the internal surface of the dispenser or as an aperture therethrough. It is also possible to define such claw engaging slots between internal ridges or protrusions.

The dispenser may be provided with a cap for sealing the outlet or a combination cap and stand such as disclosed in U.S. Pat. No. 4,964,745. The dispenser may additionally be provided with means for identifying the particular type of spread or brand of spread such as by applying lettering to the dispenser or using a color coded dispenser. Additionally, means may be provided for indicating the quantity of spread which is dispensed and/or the quantity remaining in the dispenser. Such means may include selecting the detent spacing to correspond with a pre-determined volume increment or providing a transparent portion of the dispenser as a visual indicator.

While a preferred embodiment of a dispenser has been described and illustrated herein, many other constructions will be apparent to those skilled in the art. In particular, a wide variety of materials may be used to fabricate the dispenser, such as a clear acrylic or stainless steel. Additionally, the detents may take a variety of forms, including, for example, notches having a V-shaped profile which would facilitate cleaning. Similar and entirely different piston structures may be applied to the housing of the present invention. The housing could be cylindrical for a cylindrical stick of spreadable food with the tongues having arc shapes. It is, therefore, to be understood that within the scope of the appended claims the invention may be practiced otherwise than is specifically described.

What is claimed is:

1. A device for dispensing a stick-formed spreadable food comprising:

a housing defining a chamber for holding the food, the housing having four substantially flat walls, each wall having inner and outer surfaces and upper and lower ends;

an inlet defined by the upper ends of the walls;

at least one inwardly and downwardly extending tongue formed at the lower end of one of said walls; and an outlet defined in part by a lower end of said at least one tongue; and a piston, slidable in one direction from the inlet to the outlet within the housing and having a lower face engageable with an upper end of the food for moving the food through the housing so that the food protrudes beyond the at least one tongue, wherein the housing further comprises a plurality of detents engageable by the piston for retaining the piston against motion in a direction opposite to the one direction and retaining the piston in a plurality of positions within the housing, the piston being slidable through the housing so that the piston is removable through the outlet.

2. The device of claim 1 wherein the at least one tongue comprises four inwardly and downwardly extending tongues, each formed at the lower end of a corresponding wall, and the outlet is defined by the lower ends of each of the four tongues.

3. The device of claim 2 wherein each tongue is formed unitarily with its corresponding wall.

4. The device of claim 1 wherein said at least one tongue is outwardly flexible.

5. The device of claim 1 wherein each of said plurality of detents is an elongate, laterally extending slot formed in one of the inner wall surface.

6. The device of claim 5 wherein said plurality of detents are arranged in first and second rows, each row along an opposite wall of said four walls.

7. The device of claim 6 wherein the piston further comprises first and second inwardly flexible arms for engaging the detents of the first and second rows, respectively.

8. The device of claim 7 wherein said at least one tongue is outwardly flexible.

9. A dispenser for spreadable, stick-shaped food in combination with the spreadable, stick-shaped food, the combination comprising:

a stick-shaped spreadable food;

a hollow housing having first and second ends, the food being disposed in the housing, the first end having an opening for receiving the food and the second end comprising means for resiliently engaging the food, proximate one end of the food, to hold the food within the dispenser;

a piston for exerting force on the other end of the food for pushing the food through the dispenser, so that the one end of the food extends from the dispenser for application as desired; and wherein the housing further comprises detents and the piston further comprises means for engaging the detents, and the piston is slidable through the housing from the first end to the second end so that the piston is removable through the second end of the housing, wherein the detents and means for engaging prevent motion of the piston in a direction from the second end to the first end.

10. The dispenser of claim 9 wherein the means for resiliently engaging the food comprises at least one tongue extending from the second end of the housing.

11. The dispenser of claim 10 wherein a downward direction is defined from the first to second ends of the housing, and wherein said at least one tongue is formed unitarily with the housing and extends downward and inward therefrom.

12. The dispenser of claim 11 wherein there are at least two tongues and adjacent tongues of said at least two tongues define a downwardly extending slot therebetween.

13. The dispenser of claim 9 wherein the means for engaging the detents comprises at least one upwardly extending, inwardly flexible arm.

14. The dispenser of claim 13 wherein said at least one arm comprises an outwardly facing claw, said claw having a first surface for bearing against corresponding first surfaces of the detents to resist upward motion of the piston and a second surface for engaging corresponding second surfaces of the detents for flexing the arm inwardly to permit downward motion of the piston.

15. The dispenser of claim 14, wherein said at least one arm comprises two arms.

* * * * *